US010138896B2

(12) United States Patent
Swanson

(10) Patent No.: US 10,138,896 B2
(45) Date of Patent: Nov. 27, 2018

(54) RECESSED MOTOR CEILING FAN

(71) Applicant: LAMPS PLUS, INC., Chatsworth, CA (US)

(72) Inventor: Dennis K. Swanson, Woodland Hills, CA (US)

(73) Assignee: LAMPS PLUS, INC., Chatsworth, CA (US)

( * ) Notice: Subject to any disclaimer, the term of this patent is extended or adjusted under 35 U.S.C. 154(b) by 382 days.

(21) Appl. No.: 15/142,768

(22) Filed: Apr. 29, 2016

(65) Prior Publication Data

US 2017/0314563 A1 Nov. 2, 2017

(51) Int. Cl.

| | |
|---|---|
| ***F04D 25/08*** | (2006.01) |
| ***F04D 29/00*** | (2006.01) |
| ***F04D 29/32*** | (2006.01) |
| ***F04D 29/64*** | (2006.01) |
| ***F04D 19/00*** | (2006.01) |
| ***F04D 29/60*** | (2006.01) |

(52) U.S. Cl.

CPC ..... *F04D 25/088* (2013.01); *F04D 19/002* (2013.01); *F04D 29/326* (2013.01); *F04D 29/329* (2013.01); *F04D 29/601* (2013.01)

(58) Field of Classification Search

CPC ..... F04D 25/088; F04D 25/12; F04D 29/005; F04D 29/325; F04D 29/326; F04D 29/329; F04D 29/646; F04D 19/002

See application file for complete search history.

(56) References Cited

U.S. PATENT DOCUMENTS

| | | | | |
|---|---|---|---|---|
| 1,532,635 | A * | 4/1925 | Osbun | F04D 25/14 415/146 |
| 2,142,834 | A * | 1/1939 | Bergstrom | F04D 17/16 415/143 |
| 2,148,254 | A * | 2/1939 | Bergstrom | F04D 17/16 415/121.2 |
| 2,159,913 | A * | 5/1939 | Tenney | F28D 1/024 165/125 |
| 2,350,389 | A * | 6/1944 | Coulton | B66B 11/024 454/68 |
| 3,401,621 | A * | 9/1968 | Aaberg | A01K 1/0058 454/228 |
| 6,240,247 | B1 * | 5/2001 | Reiker | F04D 25/088 392/364 |
| 8,147,182 | B2 | 4/2012 | Aynsley et al. | |
| 8,336,844 | B2 | 12/2012 | Pearce | |
| 8,393,862 | B2 | 3/2013 | Chen | |
| 8,430,541 | B2 | 4/2013 | Ko | |
| D690,409 | S | 9/2013 | Noble et al. | |
| 8,602,725 | B2 | 12/2013 | Itou et al. | |
| 8,721,305 | B2 | 5/2014 | Oleson et al. | |
| 2015/0330619 | A1 * | 11/2015 | Iwamoto | F21V 33/0096 416/5 |

FOREIGN PATENT DOCUMENTS

| | | | | |
|---|---|---|---|---|
| JP | 57163195 A * | 10/1982 | | F04D 25/10 |
| WO | WO 99/66175 | 12/1999 | | |

* cited by examiner

*Primary Examiner* — Jason Shanske
*Assistant Examiner* — Jesse Prager
(74) *Attorney, Agent, or Firm* — Karish & Bjorgum, PC

(57) ABSTRACT

A ceiling fan system wherein the motor of the ceiling fan is housed between the ceiling and the roof of an enclosure within which the ceiling fan is to be used, thereby disposing the motor out of view of occupants within the enclosure where the ceiling fan is being used.

4 Claims, 5 Drawing Sheets

RECESSED MOTOR CEILING FAN

FIELD OF THE INVENTION

The present invention relates generally to ceiling fans and more specifically to a ceiling fan assembly in which the motor is disposed a predetermined distance from the blades and is positioned above the ceiling of the enclosure in which the fan is to be utilized.

BACKGROUND OF THE INVENTION

Ceiling fans and ceiling fan systems have had a variety of components and sizes and have come in a variety of configurations over the years. The ceiling fan has been extensively applied to home and business life in order to enhance the efficiency of air conduction current throughout a room. These types of fans consist of a plurality of angularly spaced blades that are connected to the rotor portion of an electric motor mounted in a housing. The fans are adapted for installation in various types of rooms. In a low ceilinged room there is provided a flush mount model to insure adequate head clearance. For average height ceilings, the manufacture supplied hanging rod is usually sufficient to position the ceiling fan properly within the room. Where a high ceiling is utilized, extension rods are available to position the fan at an appropriate spot within the room to provide the desired air movement.

In all ceiling fans that are presently utilized, the motor which operates the hub to which the fan blades are connected is positioned in very close proximity to the hub and thus to the blades and is always visible by occupants within the enclosure such as a room in which the fan is to be utilized. Various modifications to the motor housing have been made to generate a more acceptable appearance but the result is still a relatively large and ungainly appearance.

It is thus seen that a need remains for a construction of a ceiling fan in which the motor which operates the blades is removed from view of the occupants within the enclosure where the ceiling fan is to be utilized.

SUMMARY OF THE INVENTION

In the preferred form of the present invention, there is provided a ceiling fan assembly which includes a hub having a plurality of blades secured thereto with a motor disposed a predetermined distance from the hub and positioned in a space between a ceiling and a roof of an enclosure where the fan is to be used. A drive shaft is connected between the motor and the hub to rotate the blades when the motor is activated and there is provided a means to support the motor within the space above the ceiling and below the roof of the enclosure in which the fan is to be used in such a manner that the motor is disposed above the ceiling and out of view of the occupants within the room or enclosure and the drive shaft and the hub are disposed below the ceiling.

DETAILED DESCRIPTION OF THE INVENTION

Figure 1:
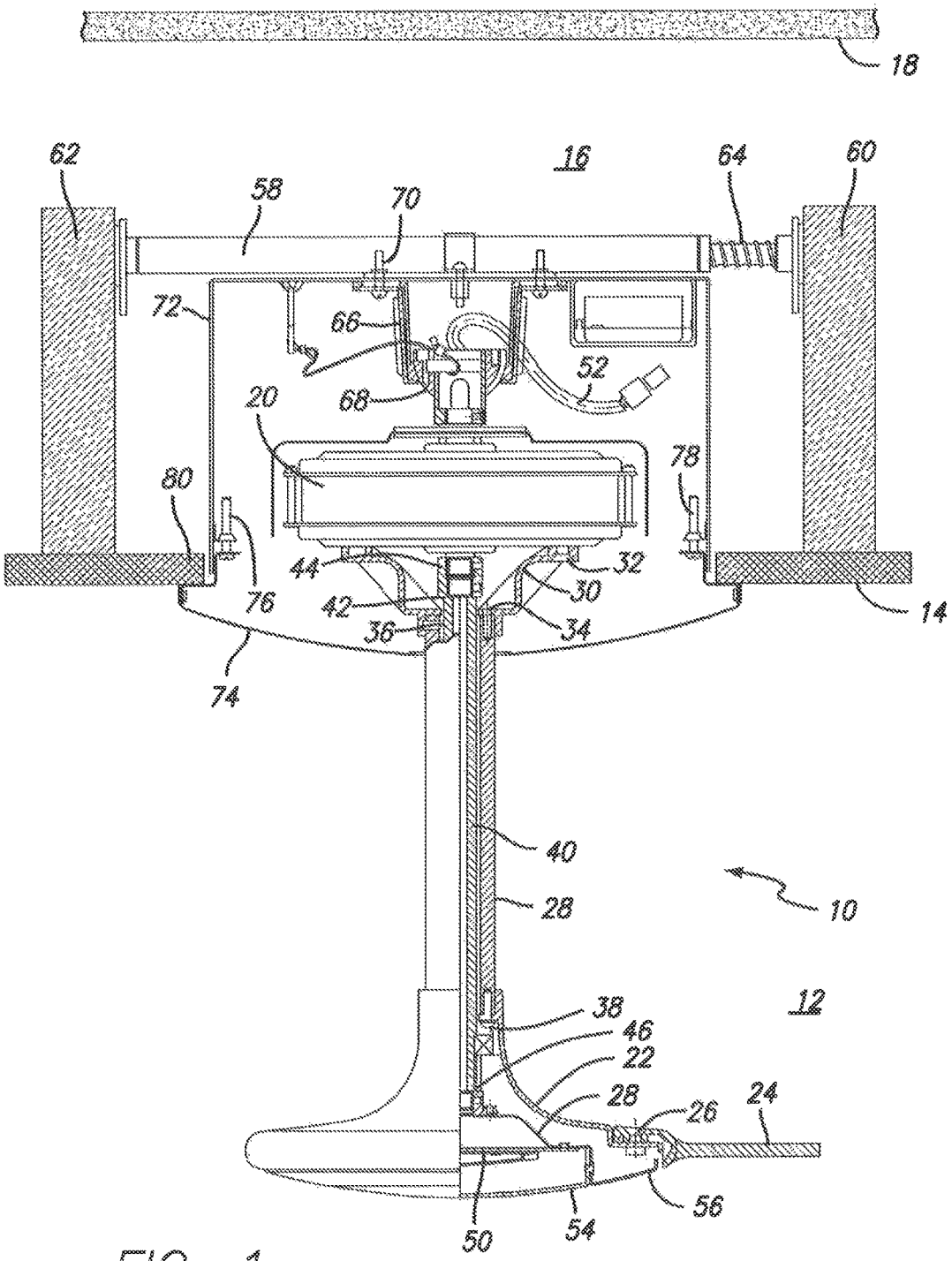
FIG. 1 is a plan view partially in cross section illustrating one embodiment of the installation of a ceiling fan in accordance with the principles of the present invention.
Figure 2:
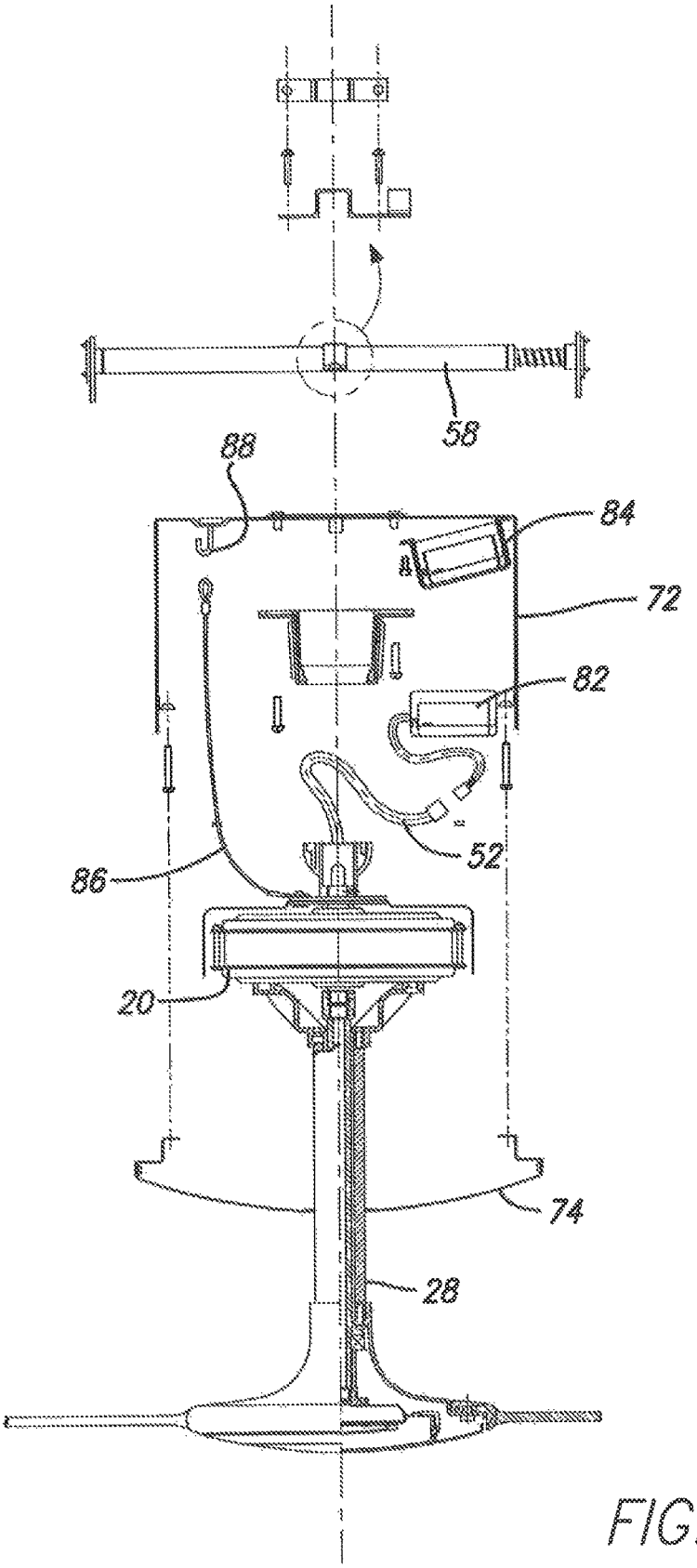
FIG. 2 is an exploded view illustrating the components of the ceiling fan of FIG. 1.
Figure 3:
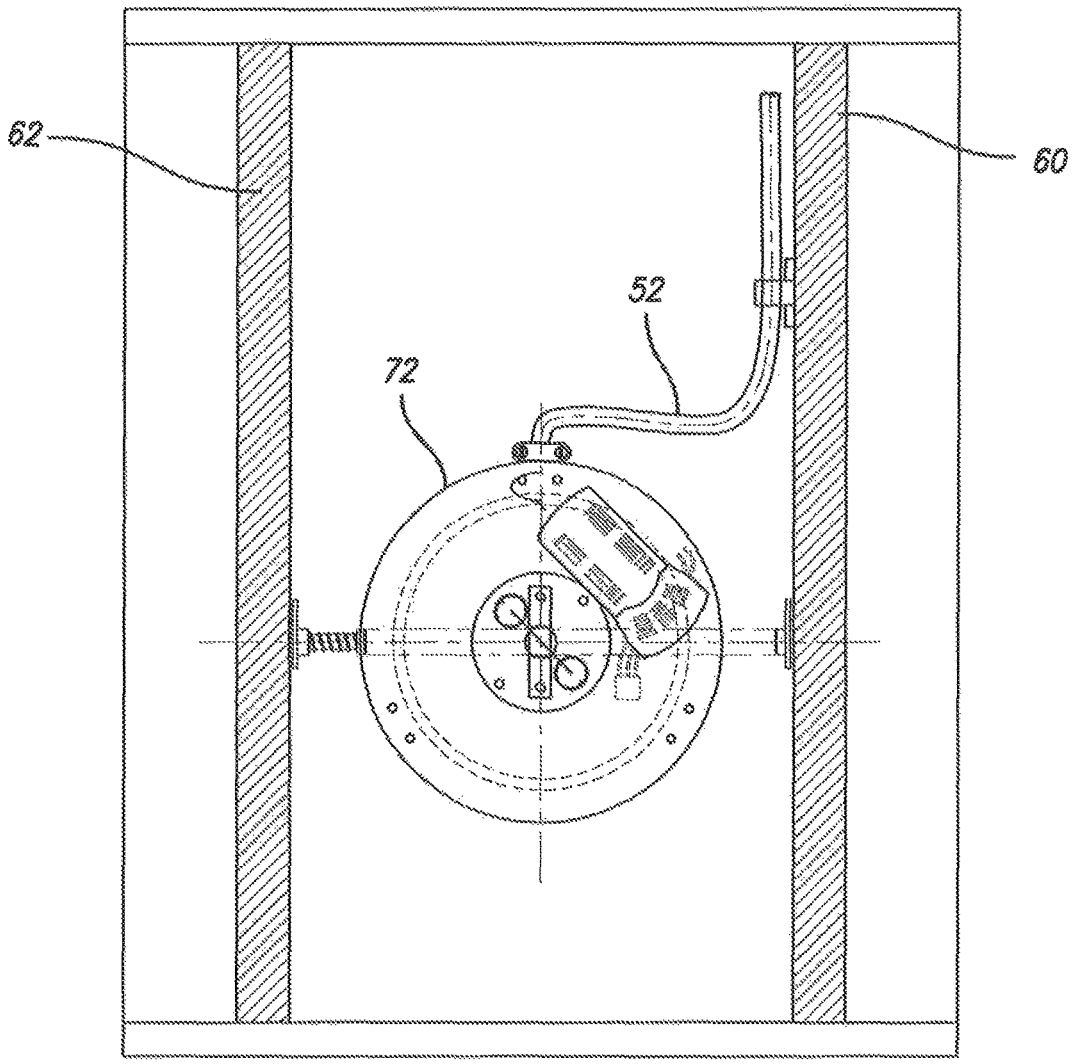
FIG. 3 is a top view of the installation of the ceiling fan of FIG. 1.

Referring now more particularly to FIGS. 1 through 3, there is illustrated a ceiling fan 10 constructed in accordance with the principles of the present invention and installed within an enclosure 12 within which the ceiling fan is to be utilized. This enclosure in this embodiment is a residence. The enclosure will be typically a room having a floor (not shown) and the upper portion of which is defined by a ceiling 14 such as drywall or tile well known to those skilled in the art. A space 16 is provided between the top of the ceiling 14 and a roof structure 18. The ceiling fan 10 includes a motor 20 and a hub or blade holder 22 to which a plurality of blades 24 are connected by means of appropriate fasteners 26 as is well known to those skilled in the art. As is clearly illustrated in FIG. 1, the motor 20 is disposed a distance away from the hub 22 and is positioned within the space 16 and above the drop tile 14 so that the motor is out of view of any occupants who may be in the enclosure 12 within which the fan is to be utilized. A drive shaft 28 is connected to the motor through a flywheel 30 which is secured to the rotor of the motor by means of fasteners 32. The flywheel is connected to the drive shaft by fasteners such as shown at 34 and 36. The opposite end of the drive shaft is connected to the hub 22 by fasteners such as shown at 38. When the motor is activated, the drive shaft rotates, thus rotating the hub 22 and the fan blades 24 connected thereto.

As is illustrated in FIG. 1, the drive shaft is hollow and a stationary tube 40 has one end 42 secured by a coupling 44 to an additional hollow tube which extends through the center of the motor 20. The opposite end 46 of the stationary tube 40 is connected to an LED lamp holder 48 which houses a substrate 50 containing a plurality of LED's. Electrical wiring 52 extends through the center of the motor and through the stationary tube 40 to provide electrical energy to the LED's mounted on the substrate 50. A shade 54 is connected by a shade holder 56 to the bottom of the LED lamp holder 48.

The motor is supported within the space 16 between the ceiling 14 and the roof 18 by a brace 58 which is supported between a pair of wooden studs 60 and 62 which form a part of the structure defining the enclosure within which the ceiling fan is to be utilized. The brace 58 is adjustably positioned by means of the threads 64 to be positioned securely against the studs 60 and 62 and is then held in position by means of appropriate fasteners. A hanger bracket 66 is secured between a fitting 68 on the top of a motor housing and the brace 58 by means of fasteners such as shown at 70. A canopy 72 is also secured by way of the fasteners 70 to the brace 58 and surrounds the motor 20. A lower canopy cover 74 is secured by fasteners 76 and 78 to the canopy 72 and covers the opening 80 provided in the ceiling 14 to accommodate the insertion of the motor into the space 16 and above the ceiling 14. As seen more clearly in FIG. 3, the electrical wiring 52 is part of the normal electrical wiring which is utilized within the structure in which the ceiling fan is to be utilized. This wiring passes into the canopy 72 and into a receiver 82 which is positioned within a bracket 84 positioned internally of the canopy 72. The system as shown in FIGS. 1 through 3 also includes a hanging cable 86 which is attached to the motor cover and which is used by the installer by attaching the same to the hook 88 to assist in supporting the weight of the ceiling fan assembly during the period of time that it is being positioned as illustrated in FIG. 1.

The structure as shown in FIGS. 1 through 3 is the embodiment of the invention which is typically utilized in a residential setting which includes the studs 60 and 62. Although a brace 58, which is adjustable, is illustrated to support the motor within the space 16, it will be understood by those skilled in the art that other supporting structure may be utilized. For example, a wooden beam or a metal channel iron can be secured between the studs 60 and 62 and the hanger bracket 66 would be secured to such an additional wooden beam or channel iron.

In industrial applications such as hotels or office buildings, the studs as shown in FIGS. 1 and 3 typically do not exist. As a result, an alternative embodiment for supporting the motor in a recessed position above the ceiling is provided and such is shown in FIGS. 4 through 6 to which reference is now made.

Figure 4:
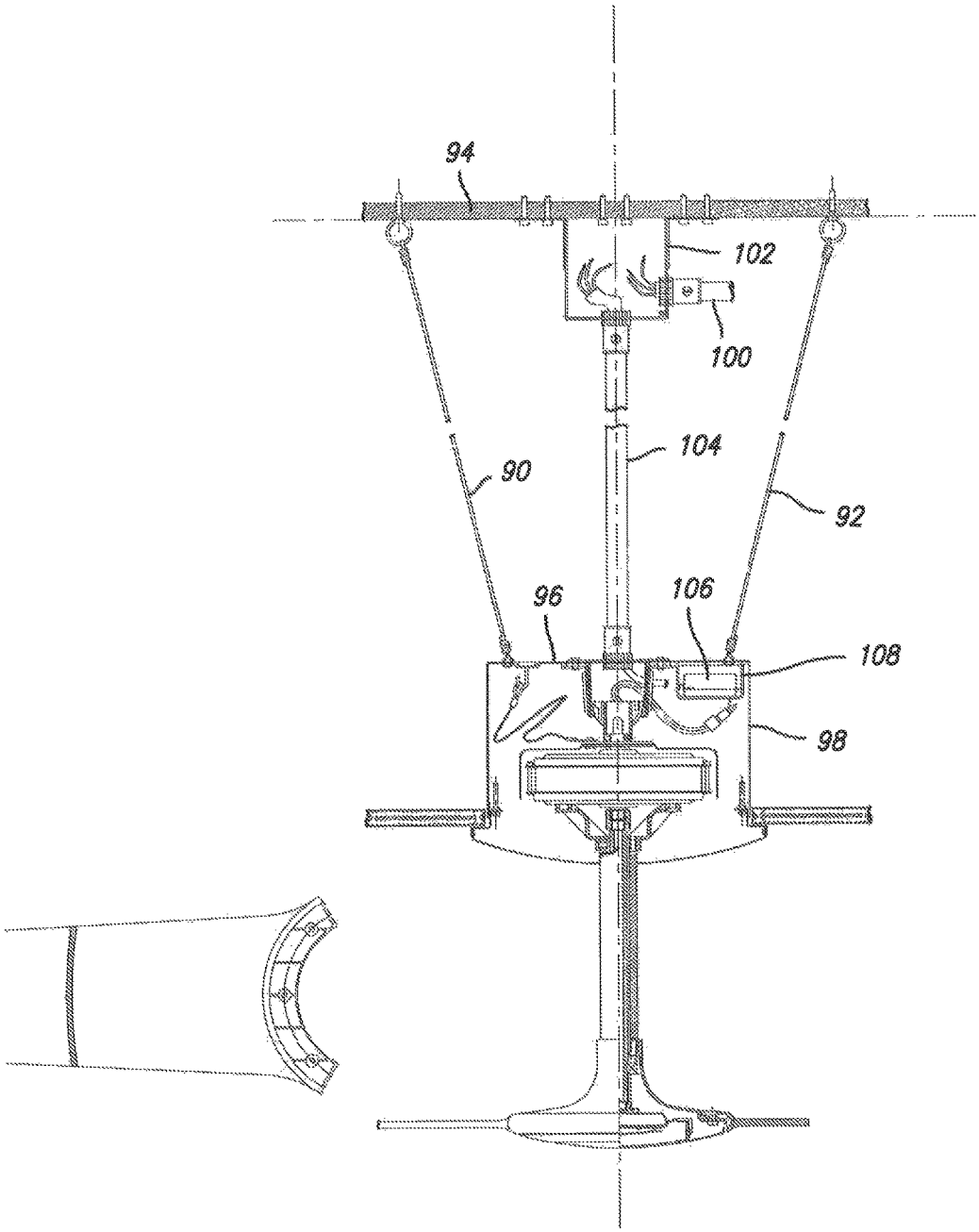
FIG. 4 is a plan view partially in cross section of an alternative embodiment of a ceiling fan constructed in accordance with the principles of the present invention.
Figure 5:
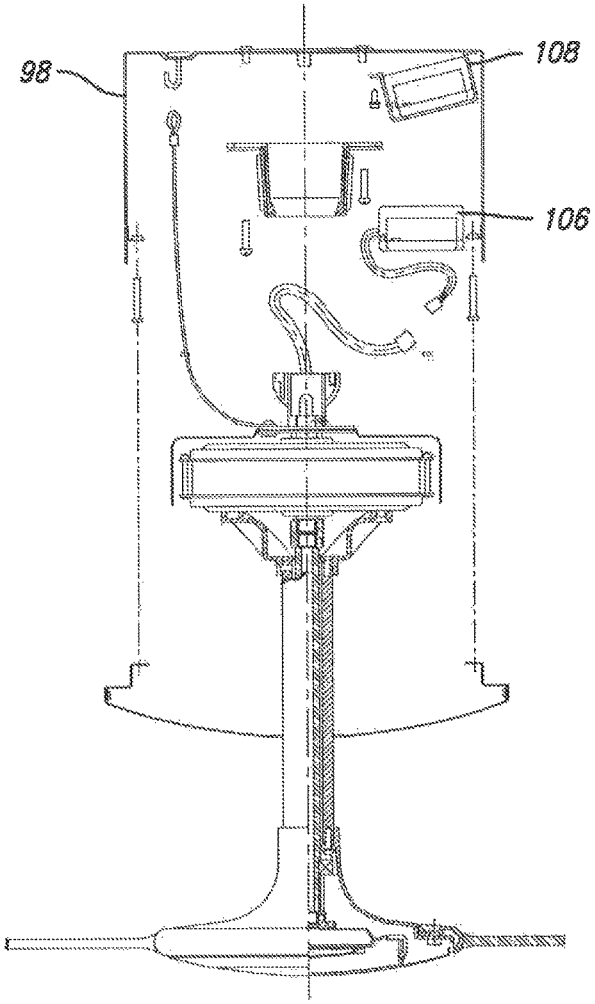
FIG. 5 is an exploded view showing the components of the fan assembly illustrated in FIG. 4.
Figure 6:
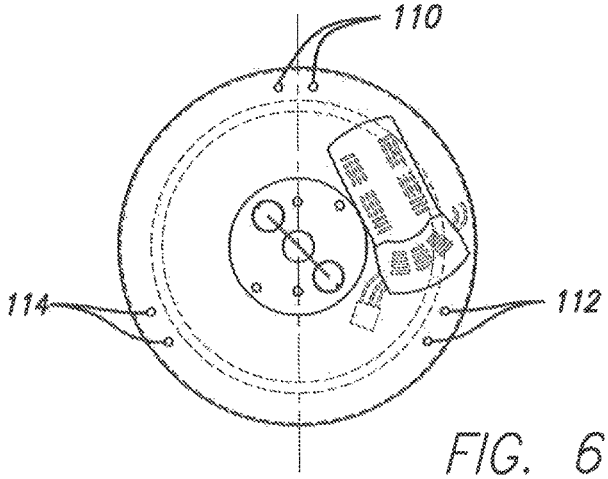
FIG. 6 is a top view showing the installation of the fan of FIG. 4.

The various portions of the motor drive shaft hub and fan blades as above described are exactly the same for the structure as shown in FIGS. 4 through 6 as that above described and therefore will not be repeated here. The primary difference is that the motor 20 is supported by a plurality of cables two of which are shown at 90 and 92. As is shown, the cables 90 and 92 are attached at one end thereof to the roof structure 94 by any fastening means desirable depending upon the material from which the roof structure 94 is constructed. The cables are then secured at the opposite ends thereof to the top 96 of the canopy 98. The electrical wiring 100 is connected into an electrical box 102 and is then passed through a hollow tube 104 downwardly into the motor canopy 98 and passed into a receiver 106 which is housed within the receiver bracket 108 and passes outwardly therefrom and into the tube positioned within the drive shaft and passes through the motor as above described.

As shown more specifically in FIG. 6, a pair of holes are provided as shown at 110, 112 and 114 to which the cables such as shown at 90 and 92 are affixed, thus making it clear that three cables are utilized to support the motor in the position as shown in FIG. 5.

There has thus been disclosed a ceiling fan assembly which allows the motor of the ceiling fan to be positioned in a space defined between the roof and the ceiling of an enclosure within which the ceiling fan is to be utilized. By positioning the motor in this manner, it is recessed above the ceiling of the enclosure and is thus not visible to occupants who are occupying the structure within which the ceiling fan is to be utilized. As a result, a much more pleasant and streamlined appearing ceiling fan is presented to the occupants of the structure in which the ceiling fan is to be utilized.

What is claimed is:

1. A ceiling fan assembly comprising:

(A) a hub;

(B) a plurality of blades secured to said hub;

(C) a motor disposed a predetermined distance from said hub in a space between a ceiling and a roof of an enclosure where said fan is to be used;

(D) a hollow drive shaft connected between said motor and said hub for rotating said blades when said motor is activated;

(E) a stationary tube disposed internally of said hollow drive shaft extending from said motor and having a distal end positioned adjacent but not connected to said hub;

(F) a substrate having a plurality of LEDs mounted thereon coupled to said distal end of said tube and electrical wires extending through said tube to provide electrical energy to said LEDs from a source thereof; and (G) a bar adapted to be secured between spaced apart beams disposed within said space as a part of the enclosure and a bracket secured to said motor and said bar for supporting said motor within said space above the ceiling of said enclosure in which said fan is to be utilized wherein said motor is disposed above said ceiling and said drive shaft and said hub are disposed below said ceiling.

2. A ceiling fan assembly as defined in claim 1 wherein said predetermined distance is determined by the distance to position said motor totally within said space and above said ceiling and out of view of any persons within said enclosure.

3. A ceiling fan assembly as defined in claim 1 which further includes a canopy affixed to said bar and extending downwardly around the motor, a hook affixed to the canopy, and a cable attached to the motor and to the hook to support the motor during installation of the ceiling fan.

4. A ceiling fan assembly as defined in claim 3 further including a cover secured to said canopy to cover an opening in the ceiling to accommodate the insertion of the motor into the space above the ceiling.

* * * * *